US009395102B2

(12) United States Patent
Hammer et al.

(10) Patent No.: US 9,395,102 B2
(45) Date of Patent: Jul. 19, 2016

(54) SELF REGULATING INLINE HEATER

(71) Applicant: MAG Aerospace Industries, LLC, Carson, CA (US)

(72) Inventors: Jason Hammer, Mukilteo, WA (US); Nguyen Tram, Chino Hills, CA (US); Timothy Birbeck, Torrance, CA (US); Christoph Goeschel, Seattle, WA (US); Razmik B. Boodaghians, Glendale, CA (US)

(73) Assignee: MAG Aerospace Industries, LLC, Carson, CA (US)

( * ) Notice: Subject to any disclaimer, the term of this patent is extended or adjusted under 35 U.S.C. 154(b) by 0 days.

(21) Appl. No.: 14/750,289

(22) Filed: Jun. 25, 2015

(65) Prior Publication Data

US 2015/0377513 A1 Dec. 31, 2015

Related U.S. Application Data

(60) Provisional application No. 62/016,864, filed on Jun. 25, 2014.

(51) Int. Cl.

| | |
|---|---|
| ***H05B 1/02*** | (2006.01) |
| ***F24H 9/20*** | (2006.01) |
| ***F24H 1/00*** | (2006.01) |
| ***F24H 1/12*** | (2006.01) |
| ***F24H 9/18*** | (2006.01) |
| ***H05B 3/82*** | (2006.01) |

(52) U.S. Cl.

CPC ..... *F24H 9/2028* (2013.01); *F24H 1/0018* (2013.01); *F24H 1/121* (2013.01); *F24H 9/1827* (2013.01); *H05B 1/0236* (2013.01); *H05B 1/0244* (2013.01); *H05B 3/82* (2013.01); *F24H 2250/04* (2013.01); *H05B 2203/02* (2013.01)

(58) Field of Classification Search

CPC ... F24H 9/2028; F24H 1/0018; H05B 1/0236; H05B 1/0244; H05B 3/12; H05B 3/14; H05B 3/145; H05B 3/50

USPC ..... 219/202, 504, 505, 497, 493

See application file for complete search history.

(56) References Cited

U.S. PATENT DOCUMENTS

| | | | | |
|---|---|---|---|---|
| 4,808,793 | A * | 2/1989 | Hurko | F24H 1/102 392/480 |
| 5,257,341 | A * | 10/1993 | Austin, Jr. | A61C 1/0069 392/487 |
| 5,271,086 | A * | 12/1993 | Kamiyama | F24H 1/142 137/341 |
| 5,801,612 | A * | 9/1998 | Chandler | H01C 7/027 338/22 R |
| 6,080,973 | A * | 6/2000 | Thweatt, Jr. | F24H 9/0047 219/497 |
| 7,158,718 | B2 * | 1/2007 | Russegger | F02M 31/125 219/207 |
| 2012/0237191 | A1 * | 9/2012 | Clark | F24H 1/102 392/454 |

* cited by examiner

*Primary Examiner* — Mark Paschall

(74) *Attorney, Agent, or Firm* — Kilpatrick Townsend & Stockton LLP; Dean W. Russell; Kristin M. Crall

(57) ABSTRACT

Embodiments provide systems and methods for improving in-line water heaters. Certain embodiments find particular use on board aircraft, other air travel vehicles (such as helicopters or aerospace vehicles), or any other vehicles that experience varying temperatures. The in-line water heaters described are self-regulating and use a temperature dependent resistance element to detect water temperature instead of a temperature sensor.

8 Claims, 2 Drawing Sheets

SELF REGULATING INLINE HEATER

CROSS REFERENCE TO RELATED APPLICATIONS

This application claims the benefit of U.S. Provisional Application Ser. No. 62/016,864, filed Jun. 25, 2014, titled "Self Regulating Inline Heater," the entire contents of which are hereby incorporated by reference.

FIELD OF THE DISCLOSURE

Embodiments of the present disclosure relate generally to heating systems that are self-regulating in-line heating systems. Certain embodiments find particular use on board vehicles, such as aircraft, which often experience fluctuations in temperatures that can be below freezing. Such low temperatures can cause damage to water lines.

BACKGROUND

Water lines often have the possibility of freezing, particularly water lines onboard passenger transportation vehicles that experience extreme temperature changes. For example, water lines on board aircraft have the possibility of freezing during flight or on normal ground use in certain environments. If water freezes in a water line, this can cause pipe rupture, disruption of normal water flow, damage to end structures, as well as a number of other problems. It is thus desirable to protect water lines against freezing.

Some solutions have been to provide spot heating on water lines in order to prevent them from freezing. One attempted solution has been to provide an external jacket around the water lines in order to keep them at a desired temperature that is lower than the freezing point. Other solutions have been to use an inline water heater that is routed inside the water line 10. Examples of this solution are shown in FIGS. 1 and 2.

The heater element may be resistance heating wire 12 that is sealed inside a tube 14 (e.g., in some instances, a Teflon tube). The wire 12 and a tube 14 combination is then inserted inside the water line 10. The water system plumbing may have various lengths of in-line water heaters positioned in the water lines at various locations along the water system plumbing. These inline water heaters are operated by a controller 16 that monitors the temperature of the heater, which is determined by one or more temperature sensors 18. The controller 16 is installed hardware that can control the heater element in order to avoid continuous operation of the heater. This is generally intended to maximize efficiency of the system so that they are not constantly heating, but instead, only heat when needed. The in-line heaters are not provided to heat the water in the water lines; they are provided to prevent freezing of the water in the water lines, so need only heat the water to a point above freezing. Accordingly, in-line heating may not be required in a warm environment and/or on a hot day.

In use, when the controller 16 senses that the set point at which the heater element should turn on has been reached (i.e., the temperature is approaching freezing), the controller 16 activates the heater wires/elements. When the controller 16 senses that the set point at which the heater element should turn off has been reached (i.e., the temperature is at a safe level where freezing will not occur), it turns off the heater wires/elements. The controller 16 switches the in-line heaters on and off by commanding corresponding circuit breakers that power the heater wires/elements 12 on and off. The controller 16 communicates with the one or more temperature sensors 18 in order to make this determination.

The temperature sensors 18 may be internal to the inline heater system or external to the heater system. FIG. 1 illustrates an in-line heater with an external temperature sensor. FIG. 2 illustrates an in-line water heater with an internal temperature sensor.

BRIEF SUMMARY

The present inventors have sought to alleviate the need for the controller/temperature sensor in-line heater systems. It is generally desirable to reduce weight on board aircraft. Weight savings can be achieved by eliminating components. In turn, this can require a lesser need for maintenance because there are fewer components that are susceptible to damage and/or that may need periodic maintenance or repair.

Embodiments of the disclosure provided herein thus provide systems and methods for improving in-line water heaters for use on-board aircraft or other vehicles where weight and space and considerations, but that may experience varying temperatures. The in-line water heaters described are self-regulating and use a temperature dependent resistance element that can change resistance in response to a change in water temperature, rather than using a temperature sensor.

DETAILED DESCRIPTION

Figure 1:
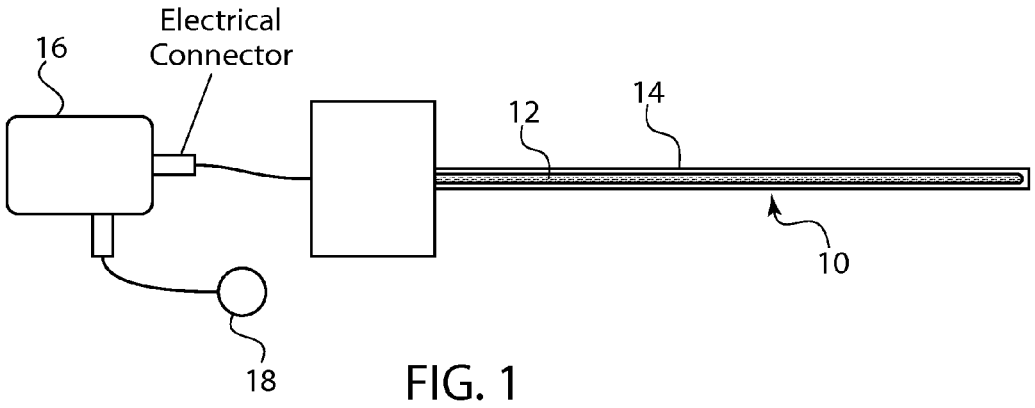
FIG. 1 shows a schematic view of a prior art in-line heater with an external temperature sensor.
Figure 2:
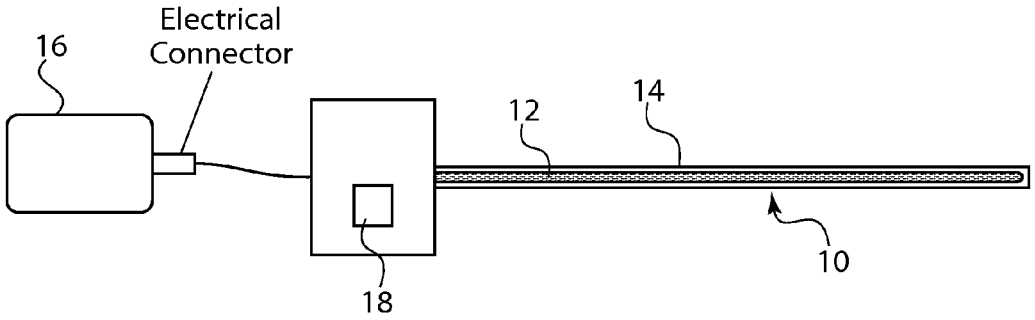
FIG. 2 shows a schematic view of a prior art in-line heater with an internal temperature sensor.
Figure 3:
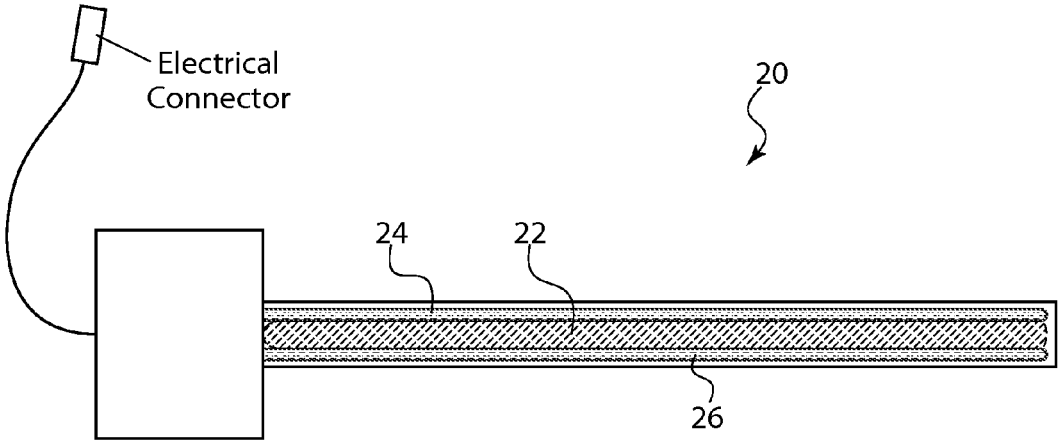
FIG. 3 shows one embodiment of a self-regulating in-line heater system.

Embodiments of the present invention provide a self-regulating in-line water heater system 20. The system 20 includes a temperature dependent resistance element 22 that connects two heater wires 24, 26. One example is illustrated by FIG. 3. In a specific example, the two heater wires 24, 26 run parallel to one another, on either side of the temperature dependent resistance element 22, such that the heater wires 24, 26 are not in contact with one another, but are both in contact with the temperature dependent resistance element 22. The heater wires 24, 26 and the temperature dependent resistance element 22 are together sealed inside a tube 28. In a specific example, the tube 28 may be a Teflon tube. In another example, the tube 28 may be an outer coating.

One of the weaknesses with inline heaters in the market is that each inline heater has a single wire coiled or wound around a string. When the heater is powered and water is introduced around it, the wire material can expand/contract and become kinked or even break. By contrast, the design disclosed herein avoid this problem. It provides a wire material that is robust enough and that can stay within the limits of a given water system.

The temperature dependent resistance element 22 can be selected such that its resistivity varies as the temperature changes. For example, when the temperature is warm enough to allow water flow, the resistance of element 22 is generally high. However, when the temperature of the water lowers to a point where the water is close to or otherwise in danger of freezing, the resistance of element 22 decreases. As the temperature of the water increases, the resistance of element 22 increases. In other words, lower temperatures will decrease the resistance locally. This decrease in resistance connect the electrical bridge therebetween, causing the heater wires 24, 26 to heat locally. For example, when the temperature of the water flowing in the water line 10 reaches a particular set low point, contact between heater wires 24, 26 will be established. For example, the low set point may be about 40° F. The use of the temperature dependent resistance element 22 alleviates the need for temperature sensors or a controller to operate the system. Instead, the system is self-regulating and will heat as needed. When the temperature rises above a high set point, the contact between the heater wires is interrupted and their heating will turn stop. In one particular example, the high set point may be about 50° F.

Traditionally, heater wires are provided within a cover or sleeve. Such may be the case with wires 24, 26. In one example, the heater wires 24, 26 may be PTFE fluoro-polymer insulated heating wires. Additionally or alternatively, in one example of this disclosure, each of the heater wires 24, 26 may be coated with an inert chemical component that serves as a plastic "cover" 30.

The temperature dependent resistance element 22 may be provided as a cement-like mixture that bonds the two heater wires 24, 26 to the element 22. This cement-like component/mixture may vary the resistance between the wires 24, 26. In one example, the component may be a special alloy such as nickel chromium or another metallic-based cement or metal adhesive. The component acts as a binder between the two heater wires 24, 26 and may allow varied resistance between the wires 24, 26 based on temperature. The resistance of the heater wires 24, 26 does not change. The heater wires 24, 26 are only connective when the resistance of the inner element 22 decreases. In this example, the temperature dependent resistance element 22 is an "intelligent cement." The metal ions in the cement provide varying resistance, depending upon the temperature of the environment. The metallic cement provides the function of a binder between the wires 24, 26, as well as creating varied resistance therebetween. The use of this metallic cement/temperature dependent resistance element 22 eliminates the need for a controller or temperature sensors. The resistance element 22 allows contact between the heater wires 24, 26 in order to create a circuit when the temperature reaches a certain low level.

The metallic cement may be varied in metallic composition, depending upon the size of the system and the desired temperature points. The non-metallic binder of the cement may be a potting epoxy used with electrical circuits, other epoxies, silicone oxide, a polymer base, an organic or inorganic compound, or combinations thereof. The metallic component may be nickel chromium, alumina, titanium, mayenite, alkali metal, or combinations thereof.

Figure 4:
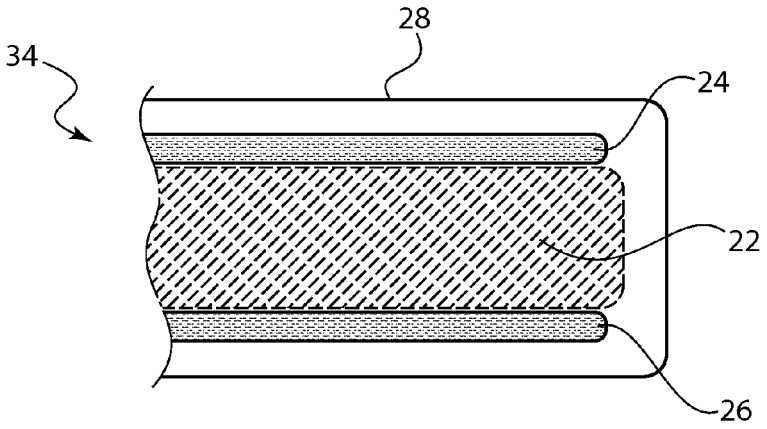
FIG. 4 shows a cut away view of one embodiment of a self-regulating in line heater component.

As is shown in FIG. 4, the temperature dependent resistance element 22 is not connected to the electrical circuitry, but is sandwiched between the wires 24, 26. There is not a terminal connection point for the wires. The wires are only in communication with one another via a temperature dependent resistance element 22. A coating or tube is positioned around these components. The combination of the element 22 and wires 24, 26 in the tube 28 may be referred to as a self-regulating heater component 34.

The self-regulating heater component 34 is intended to be a flexible component that can navigate curved water lines. The self-regulating heater component 34 is also designed to fit within a thin water line. For example, many water lines on board an aircraft are at less than 1 inch in diameter. In specific embodiments, they may be ⅜ inch thick or ½ inch in diameter. Thus, the self-regulating heater component 34 may be designed to have a diameter that is about 4-5 mm or less. It should be understood that the diameter of the self-regulating heater component 34 is dependent upon the diameter of the water line it is used to treat. If the water line has a larger diameter, then it is possible to use a self-regulating heater component 34 that has a larger diameter, such that it is scaled relative to the water line pipe. It is generally preferred that the self-regulating heater component 34 does not interrupt with the pressure or flow of water at the end point.

The self-regulating heater component 34 may also be designed to be inserted into a pipe of water line and easily removed if necessary. This can ease cleaning of the self-regulating heater component 34. This can also make any repairs that may need to be made to the self-regulating heater component 34 more efficient. The self-regulating heater component 34 is not designed to be wrapped around the waterline, which would add weight to the aircraft. Instead, it is positioned directly within the waterline, in the stream of water flowing therein. This allows the heater component 34 to be shorter and more efficient, as it is in direct contact with the water to be warmed.

In other embodiments, it is possible to provide a plurality of shorter self-regulating heater components 34 that are positioned only along areas of the waterline that are more prone to freezing.

Figure 5:
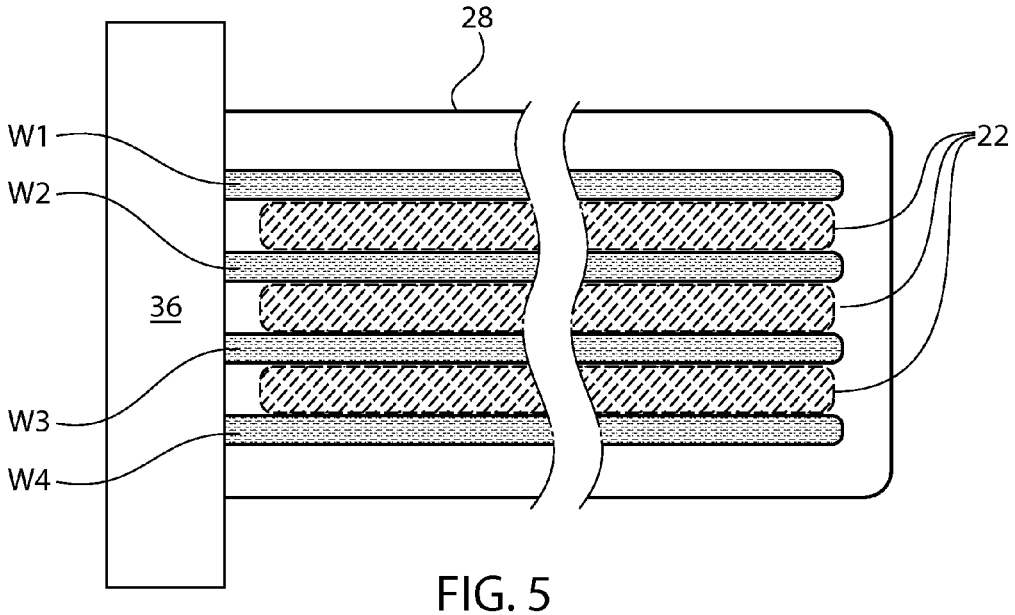
FIG. 5 shows an alternate embodiment including more than two heater wires.

As also shown in FIG. 5, two heater wires (or more than two heater wires, as shown) may be connected to electrical circuitry 36. Each connection point may be bonded with epoxy or other compound to prevent fluid ingression into the electrical circuitry 36 and to provide a moisture barrier. The inner element 22 is not connected to the circuitry 36. The heater wires are not connected to one another at a termination point. Activation of the heater wires 24, 26 is dependent only upon decreased resistivity of the temperature dependent resistance element 22 when the temperature decreases. The electrical circuitry 36 relies on signals from the top and bottom heater wires 24, 26. Once power is applied to the heater wires 24, 26 via electrical circuitry 36, the resistance of the wires increases, and electricity flows, generating heat.

Although a single self-regulating heater component 34 is shown, it is understood that more than one or more heater components 34 may be positioned within a single waterline. It is also understood that more than one heater components 34 may be twisted or otherwise combined together in order to provide a more robust or a quicker burst of heat. In another embodiment, it is also possible for the heater wires 24, 26 to be split into other resistors, such that a plurality of heater wires (e.g., represented as wires W1, W2, W3, and W4) may be provided, as shown in FIG. 5. In this embodiment, a temperature dependent resistance element 22 may be provided between each of the wires.

Changes and modifications, additions and deletions may be made to the structures and methods recited above and shown in the drawings without departing from the scope or spirit of the disclosure or the following claims.

What is claimed is:

1. A self-regulating in-line heater system for use in a water line, comprising:

first and second heater wires;

a metallic cement functioning as a temperature dependent resistance element positioned between and bonded to the first and second heater wires;

a tube sealing the wires and the metallic cement along at least a substantial length of the in-line heater in a liquid-tight manner, wherein the in-line heater is positioned within a water line in use, wherein when water in the water line decreases in temperature below a particular set point, resistance of the metallic cement decreases, establishing electrical contact between the first and second heater wires to create an electrical circuit such that heating occurs, wherein when water in the water line increases in temperature above a particular set point, resistance of the metallic cement increases, interrupting contact between the first and second heater wires such that heating does not occur;

wherein occurrence of contact between the first and second heater wires is dependent only upon the water temperature and occurs without a controller or temperature sensor.

2. The in-line heater system of claim 1, further comprising electrical circuitry connected to the first and second heater wires for applying power to the first and second heater wires.

3. The in-line heater system of claim 1, wherein the tube comprises a Teflon tube.

4. The in-line heater system of claim 1, wherein the first and second heater wires, the temperature dependent resistance element, and the tube form a heater component that is less than about 5 mm in diameter.

5. The in-line heater system of claim 1, wherein the in-line heater system is installed in an interior of a water line pipe.

6. The in-line heater system of claim 1, wherein the in-line heater system is installed in an interior of a water line pipe on board an aircraft to prevent freezing of aircraft water lines in various conditions.

7. The in-line heater system of claim 1, wherein the in-line heater system comprises a plurality of heater wires, each separated by a metallic cement layer.

8. A method for preventing freezing of water in a water line on board an aircraft, comprising:

providing the self-regulating in-line heater system of claim 1, installing the self-regulating in-line heater system in the water line; and connecting the first and second wires to electrical circuitry.

* * * * *